US008522372B1

(12) United States Patent
Lafon et al.

(10) Patent No.: US 8,522,372 B1
(45) Date of Patent: Sep. 3, 2013

(54) ILLUMINATED POOL FOUNTAIN SYSTEM

(76) Inventors: Matthew L. Lafon, Tampa, FL (US); Randy D. Messer, Gulf Breeze, FL (US)

( * ) Notice: Subject to any disclaimer, the term of this patent is extended or adjusted under 35 U.S.C. 154(b) by 210 days.

(21) Appl. No.: 13/136,770

(22) Filed: Aug. 10, 2011

(51) Int. Cl.
*E04H 4/00* (2006.01)

(52) U.S. Cl.
USPC ..... 4/496; 362/96; 239/18

(58) Field of Classification Search
USPC ..... 4/496, 490, 491, 492; 239/16–18, 239/20, 71–73, 289, 211; 362/149, 253, 362/562, 96, 318
See application file for complete search history.

(56) References Cited

U.S. PATENT DOCUMENTS 3,318,528 A * 5/1967 Williams ..... 4/496
3,722,816 A * 3/1973 Stewart et al. ..... 4/490
4,174,808 A * 11/1979 Latin ..... 239/23
4,901,922 A * 2/1990 Kessener et al. ..... 239/12
4,936,506 A * 6/1990 Ryan ..... 239/18
5,839,821 A * 11/1998 LeZotte ..... 362/253
6,393,192 B1 * 5/2002 Koren ..... 239/18
6,644,561 B1 * 11/2003 Daane ..... 239/18
8,333,331 B1 * 12/2012 Fuller et al. ..... 239/17
2006/0101570 A1 * 5/2006 Kunkel ..... 4/507

* cited by examiner

*Primary Examiner* — Huyen Le
*Assistant Examiner* — Erin Deery

(57) ABSTRACT

A vertical pipe has an upper end and a lower end. The vertical pipe is adapted to be coupled to a pool water outlet. A T-coupler has horizontal first and second legs and a downward extending vertical third leg receiving the T-coupler. Transparent first and second sleeves are attached to the first leg and second legs. Each sleeve has an end cap. An inner cylinder is provided within the second sleeve. The inner cylinder has closed and open ends. A power cylinder is provided within the first sleeve. A gasket hydraulically seals the first sleeve from the second sleeve and the T-coupler. A light source is coupled to the power cylinder extending into the T-coupler. Apertures are provided in the second sleeve. The apertures face upwardly and outwardly.

8 Claims, 3 Drawing Sheets

FIG. 1
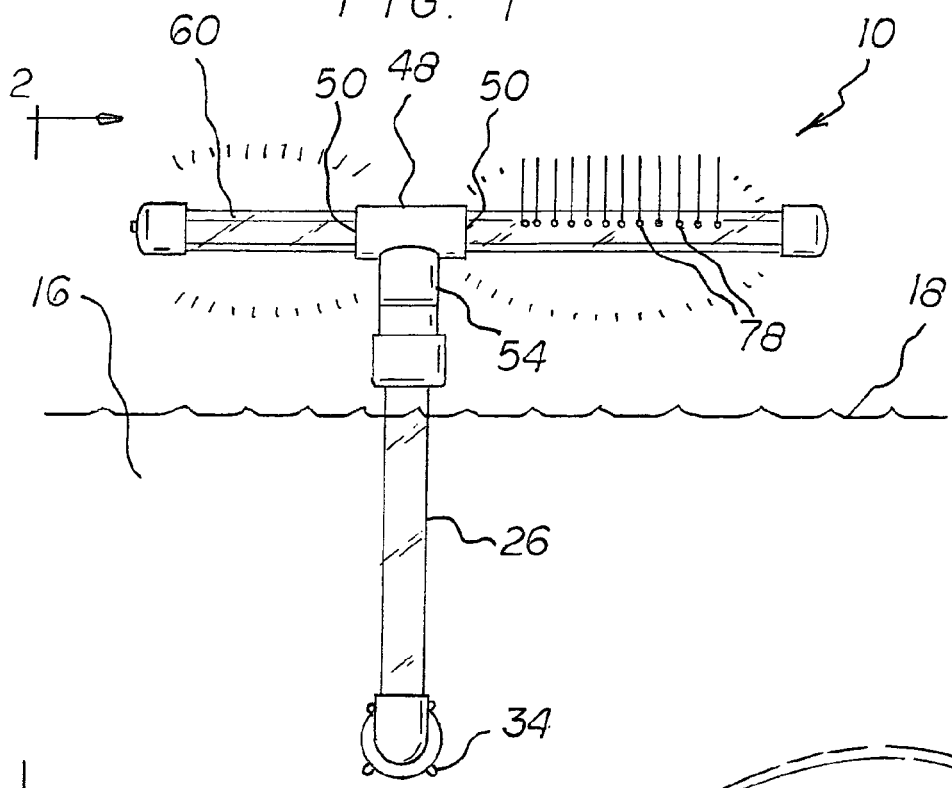
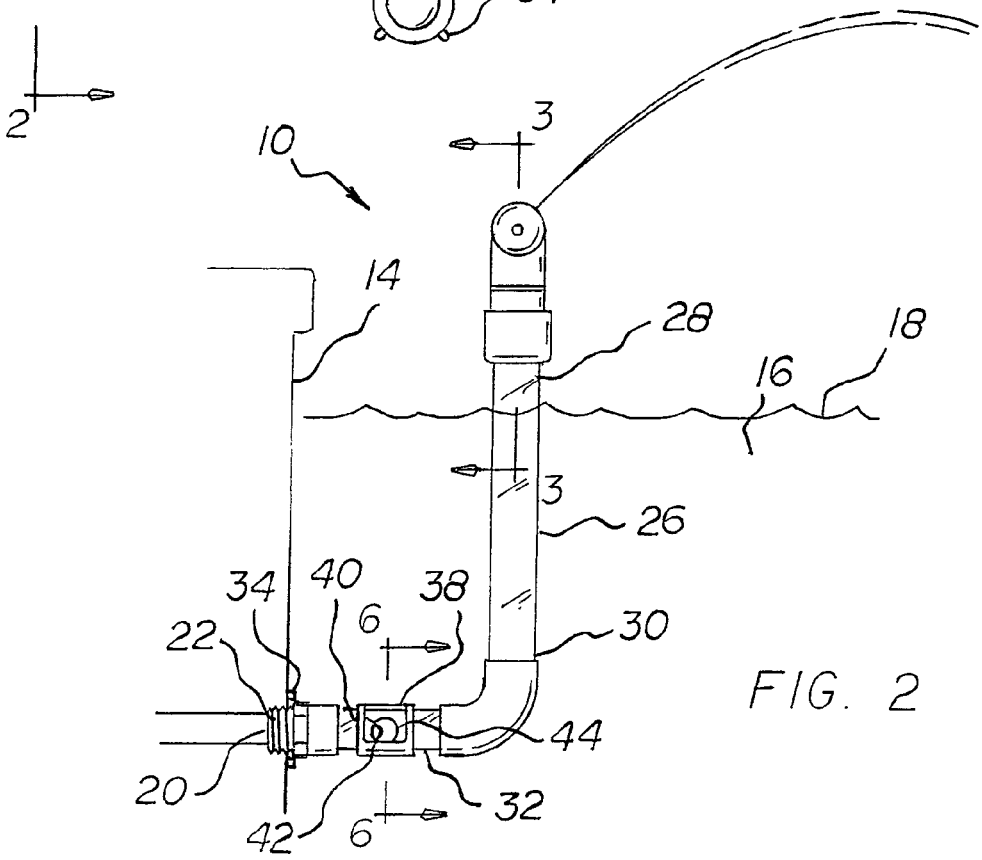
FIG. 2

FIG. 6
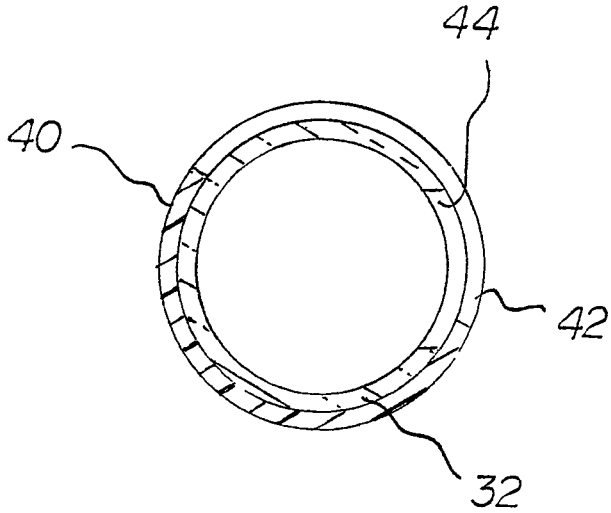
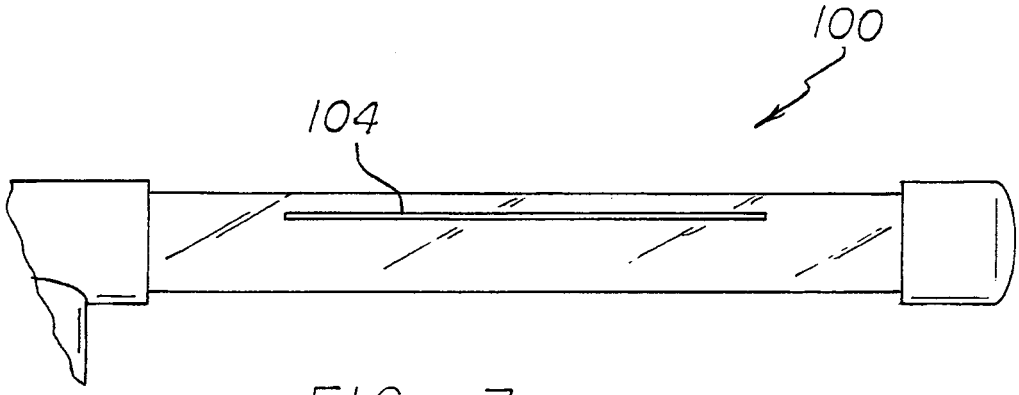
FIG. 7
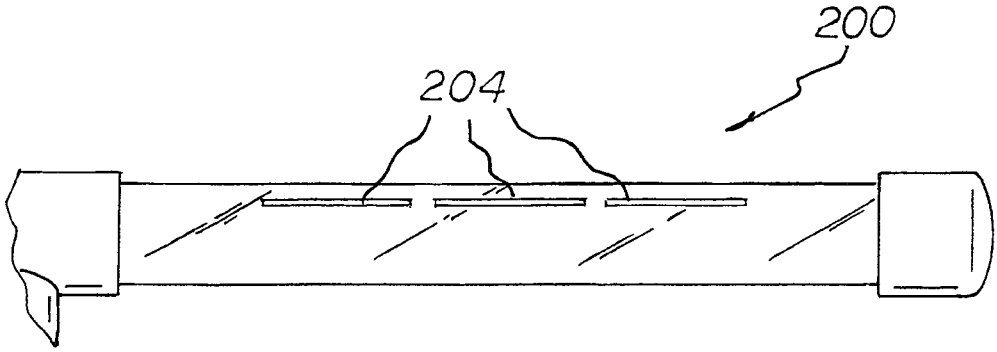
FIG. 8

ILLUMINATED POOL FOUNTAIN SYSTEM

BACKGROUND OF THE INVENTION

Field of the Invention

The present invention relates to an illuminated pool fountain system and more particularly pertains to projecting a spray of water in a pool while illuminating the water and the system, the projecting and illuminating being done in a safe, convenient and economical manner.

SUMMARY OF THE INVENTION

In view of the disadvantages inherent in the known types of fountain systems of known designs and configurations now present in the prior art, the present invention provides an improved illuminated pool fountain system. As such, the general purpose of the present invention, which will be described subsequently in greater detail, is to provide a new and improved illuminated pool fountain system and method which has all the advantages of the prior art and none of the disadvantages.

To attain this, the present invention essentially comprises an illuminated pool fountain system. First provided is a pool. The pools contains a quantity of water. The water has a waterline. The pool has a water outlet. The water outlet is provided beneath the waterline. In this manner water is ejected into the pool. The outlet has female screw threads.

A vertical pipe is provided. The vertical pipe has an upper end. The upper end is provided above the waterline. The vertical pipe has a lower end. The lower end is provided below the waterline. The lower end has a 90 degree bend. The lower end terminates in a lower free end. A horizontal connector pipe is provided. The horizontal connector pipe couples the lower free end of the vertical pipe and the water outlet. A threaded collar is provided. The threaded collar is provided adjacent to the water outlet. The threaded collar is rotatable around the connector pipe. In this manner the connector pipe may be tightened and loosened with respect to the water outlet.

A pressure adjusting assembly is provided. The pressure adjusting assembly includes a rotatable sleeve. The rotatable sleeve is in a cylindrical configuration. The rotatable sleeve is co-axially mounted on the horizontal pipe. The rotatable sleeve has a rectangular exterior aperture. The horizontal pipe has a circular interior aperture. The rotatable sleeve is rotatable between an open first orientation and a closed second orientation. In the open first orientation, the interior and exterior apertures are aligned. In the closed second orientation, the interior and exterior apertures are un-aligned. In this manner the pressure of the water flowing there through may be varied as a function of the rotational orientation of the rotatable sleeve with respect to the horizontal pipe.

A T-coupler is provided next. The T-coupler has a horizontal first leg. The T-coupler has an axially aligned horizontal second leg. The T-coupler has a downward extending vertical third leg. The vertical third leg has male screw threads. The upper end of the vertical pipe has a joining component. The joining component has female screw threads. In this manner the T-coupler is removably received.

Provided next is a transparent plastic first sleeve. The first sleeve has an interior end. The interior end of the first sleeve is attached to the first leg of the T-coupler. The first sleeve has a second end. The second end of the first sleeve has a first cap. A transparent plastic second sleeve is provided. The second sleeve has an interior end. The interior end of the second sleeve is attached to the second leg of the T-coupler. The second sleeve has a second end. The second end of the second sleeve has a second cap.

Further provided is an illumination assembly. The illumination assembly has an inner cylinder. The inner cylinder is of a translucent cellulose material. The inner cylinder is provided in the second sleeve. The inner cylinder has a closed end. The closed end of the inner cylinder is provided adjacent to the second cap. The inner cylinder has an open end. The open end of the inner cylinder is provided within the T-coupler. The illumination assembly also includes a power cylinder. The power cylinder has a first end. The first end of the power cylinder is provided adjacent to the first cap. The first end of the power cylinder has a button. The button extends through the first cap. The power cylinder has a second end. The second end of the power cylinder is provided within the T-coupler. A gasket is provided. The gasket is provided around the T-coupler. In this manner the first sleeve is hydraulically sealed from the second sleeve and the T-coupler. A plurality of light emitting diodes is provided. The light emitting diodes are coupled to the second end of the power cylinder. The light emitting diodes extend into the T-coupler. A plurality of batteries are provided. The batteries are provided within the power cylinder. Electronic logic is provided. The electronic logic is provided within the first sleeve. The electronic logic is operative in response to depressing the button. In this manner the light emitting diodes are activated and inactivated. The depressing of the button is adapted to optionally operate the light emitting diodes in a continuous and discontinuous modes.

Provided last is a spray assembly. The spray assembly includes apertures. The apertures are provided in the second sleeve. The apertures face upwardly and outwardly. In this manner water is adapted to move through the outlet. Water is also adapted to move through the pressure adjusting assembly. Water is adapted to move through the T-coupler. Water is then adapted to move through the second sleeve exterior of the translucent sleeve. Further in this manner water is adapted to exit through the apertures. In this manner exiting water creates an illuminated fountain-like appearance while the light emitting diodes illuminate the exiting water and the first and second sleeves.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated pool fountain system which has all of the advantages of the prior art fountain systems of known designs and configurations and none of the disadvantages.

It is another object of the present invention to provide a new and improved illuminated pool fountain system which may be easily and efficiently manufactured and marketed.

It is further object of the present invention to provide a new and improved illuminated pool fountain system which is of durable and reliable constructions.

An even further object of the present invention is to provide a new and improved illuminated pool fountain system which is susceptible of a low cost of manufacture with regard to both materials and labor, and which accordingly is then susceptible of low prices of sale to the consuming public, thereby making such illuminated pool fountain system economically available to the buying public.

Even still another object of the present invention is to provide an illuminated pool fountain system for projecting a spray of water in a pool while illuminating the water and the system, the projecting and illuminating being done in a safe, convenient and economical manner.

Lastly, it is an object of the present invention to provide a new and improved illuminated pool fountain system. A vertical pipe has an upper end and a lower end. The vertical pipe is adapted to be coupled to a pool water outlet. A T-coupler has horizontal first and second legs and a downward extending vertical third leg receiving the T-coupler. Transparent first and second sleeves are attached to the first leg and second legs. Each sleeve has an end cap. An inner cylinder is provided within the second sleeve. The inner cylinder has closed and open ends. A power cylinder is provided within the first sleeve. A gasket hydraulically seals the first sleeve from the second sleeve and the T-coupler. A light source is coupled to the power cylinder extending into the T-coupler. Aperture means are provided in the second sleeve. The apertures face upwardly and outwardly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an illuminated pool fountain system constructed in accordance with the principles of the present invention.

FIG. 2 is a side elevational view taken along line 2-2 of FIG. 1.

FIG. 6 is a cross sectional view taken along line 6-6 of FIG. 2.

FIGS. 7 and 8 are front elevational views of illuminated pool fountain systems constructed in accordance with alternate embodiments of the invention.

The same reference numerals refer to the same parts throughout the various Figures.

DESCRIPTION OF THE PREFERRED EMBODIMENT

Figures 3, 4, 5:
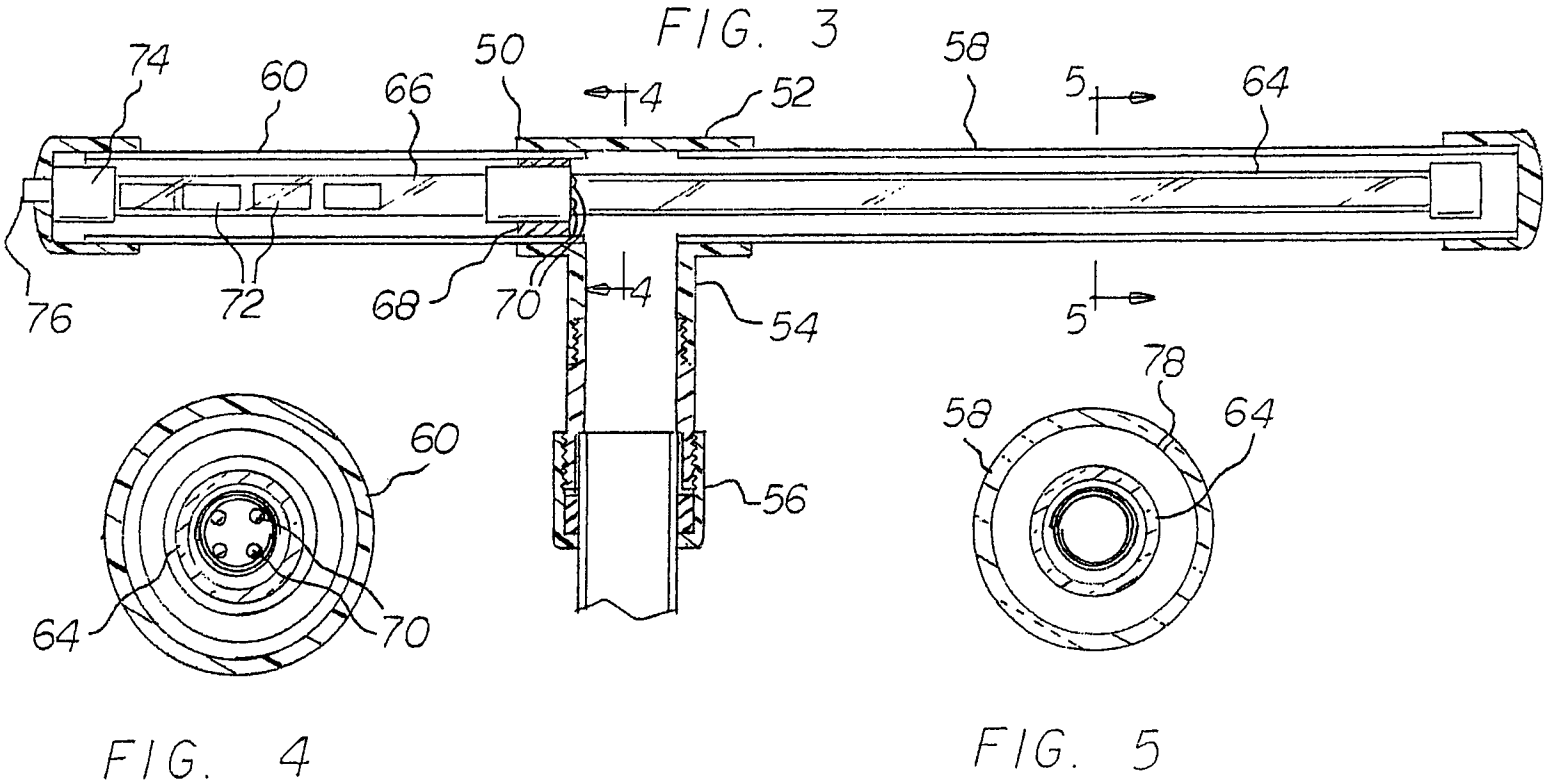
FIG. 3 is a cross sectional view taken along line 3-3 of FIG. 2.
FIGS. 4 and 5 are cross sectional views taken along lines 4-4 and 5-5 of FIG. 3.

With reference now to the drawings, and in particular to FIG. 1 thereof, the preferred embodiment of the new and improved illuminated pool fountain system embodying the principles and concepts of the present invention and generally designated by the reference numeral 10 will be described.

The present invention, the illuminated pool fountain system 10 is comprised of a plurality of components. Such components in their broadest context include a vertical pipe, a T-coupler, transparent first and second sleeves, an inner cylinder and aperture means. Such components are individually configured and correlated with respect to each other so as to attain the desired objective.

First provided is a pool 14. The pools contains a quantity of water 16. The water has a waterline 18. The pool has a water outlet 20. The water outlet is provided beneath the waterline. In this manner water is ejected into the pool. The outlet has female screw threads 22.

A vertical pipe 26 is provided. The vertical pipe has an upper end 28. The upper end is provided above the waterline. The vertical pipe has a lower end 30. The lower end is provided below the waterline. The lower end has a 90 degree bend. The lower end terminates in a lower free end. A horizontal connector pipe 32 is provided. The horizontal connector pipe couples the lower free end of the vertical pipe and the water outlet. A threaded collar 34 is provided. The threaded collar is provided adjacent to the water outlet. The threaded collar is rotatable around the connector pipe. In this manner the connector pipe may be tightened and loosened with respect to the water outlet.

A pressure adjusting assembly 38 is provided. The pressure adjusting assembly includes a rotatable sleeve 40. The rotatable sleeve is in a cylindrical configuration. The rotatable sleeve is co-axially mounted on the horizontal pipe. The rotatable sleeve has a rectangular exterior aperture 42. The horizontal pipe has a circular interior aperture 44. The rotatable sleeve is rotatable between an open first orientation and a closed second orientation. In the open first orientation, the interior and exterior apertures are aligned. In the closed second orientation, the interior and exterior apertures are unaligned. In this manner the pressure of the water flowing there through may be varied as a function of the rotational orientation of the rotatable sleeve with respect to the horizontal pipe.

A T-coupler 48 is provided next. The T-coupler has a horizontal first leg 50. The T-coupler has an axially aligned horizontal second leg 52. The T-coupler has a downward extending vertical third leg 54. The vertical third leg has male screw threads. The upper end of the vertical pipe has a joining component 56. The joining component has female screw threads. In this manner the T-coupler is removably received.

Provided next is a transparent plastic first sleeve 60. The first sleeve has an interior end. The interior end of the first sleeve is attached to the first leg of the T-coupler. The first sleeve has a second end. The second end of the first sleeve has a first cap. A transparent plastic second sleeve 58 is provided. The second sleeve has an interior end. The interior end of the second sleeve is attached to the second leg of the T-coupler. The second sleeve has a second end. The second end of the second sleeve has a second cap.

Further provided is an illumination assembly. The illumination assembly has an inner cylinder 64. The inner cylinder is of a translucent cellulose material. The inner cylinder is provided in the second sleeve. The inner cylinder has a closed end. The closed end of the inner cylinder is provided adjacent to the second cap. The inner cylinder has an open end. The open end of the inner cylinder is provided within the T-coupler. The illumination assembly also includes a power cylinder 66. The power cylinder has a first end. The first end of the power cylinder is provided adjacent to the first cap. The first end of the power cylinder has a button 76. The button extends through the first cap. The power cylinder has a second end. The second end of the power cylinder is provided within the T-coupler. A gasket 68 is provided. The gasket is provided around the T-coupler. In this manner the first sleeve is hydraulically sealed from the second sleeve and the T-coupler. A plurality of light emitting diodes 70 is provided. The light emitting diodes are coupled to the second end of the power cylinder. The light emitting diodes extend into the T-coupler. A plurality of batteries 72 are provided. The batteries are provided within the power cylinder. Electronic logic 74 is provided. The electronic logic is provided within the first sleeve. The electronic logic is operative in response to depressing the button. In this manner the light emitting diodes are activated and inactivated. The depressing of the button is adapted to optionally operate the light emitting diodes in a continuous and discontinuous modes.

Provided last is a spray assembly. The spray assembly includes apertures 78. The apertures are provided in the second sleeve. The apertures face upwardly and outwardly. In this manner water is adapted to move through the outlet. Water is also adapted to move through the pressure adjusting assembly. Water is adapted to move through the T-coupler. Water is then adapted to move through the second sleeve exterior of the translucent sleeve. Further in this manner water is adapted to exit through the apertures. In this manner exiting water creates an illuminated fountain-like appearance while the light emitting diodes illuminate the exiting water and the first and second sleeves.

An alternate embodiment 100 of the present invention is provided. The aperture means is a linear slot 104. Note FIG. 7 for the first alternate embodiment of the invention.

Another alternate embodiment 200 of the present invention is provided. The aperture means are aligned linear slots 206. Note FIG. 8 for the second alternate embodiment of the invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated pool fountain system comprising:

a vertical pipe having an upper end and a lower end adapted to be coupled to a pool water outlet;

a T-coupler having horizontal first and second legs and a downward extending vertical third leg receiving the T-coupler;

transparent first and second sleeves attached to the first leg and second legs, each sleeve having an end cap;

an inner cylinder within the second sleeve, the inner cylinder having closed and open ends, a power cylinder within the first sleeve, a gasket hydraulically sealing the first sleeve from the second sleeve and the T-coupler, a light source coupled to the power cylinder extending into the T-coupler; and aperture means in the second sleeve, the apertures facing upwardly and outwardly.

2. The system as set forth in claim 1 and further including:

a pressure regulator between the pool water outlet and the T-coupler.

3. The system as set forth in claim 1 and further including:

electronic logic within the first sleeve operative in response to an operator for activating and inactivating the light source.

4. The system as set forth in claim 3 wherein the operator controlled logic is adapted to optionally operate the light source in a continuous and discontinuous modes.

5. The system as set forth in claim 1 wherein the aperture means are aligned circular holes.

6. The system (100) as set forth in claim 1 wherein the aperture means is a linear slot (104).

7. The system (200) as set forth in claim 1 wherein the aperture means are aligned linear slots (206).

8. An illuminated pool fountain system (10) for projecting a spray of water in a pool while illuminating the water and the system, the projecting and illuminating being done in a safe convenient and economical manner, the system comprising, in combination:

a pool (14) containing a quantity of water (16), the water having a waterline (18), the pool having a water outlet (20) beneath the waterline ejecting water into the pool, the outlet having female screw threads (22);

a vertical pipe (26) having an upper end (28) above the waterline and a lower end (30) below the waterline, the lower end formed with a 90 degree bend terminating in a lower free end, a horizontal connector pipe (32) coupling the lower free end of the vertical pipe and the water outlet, a threaded collar (34) adjacent to the water outlet and rotatable around the connector pipe for tightening and loosening the connector pipe with respect to the water outlet;

a pressure adjusting assembly (38) including a rotatable sleeve (40) in a cylindrical configuration co-axially mounted on the horizontal pipe, the rotatable sleeve having a rectangular exterior aperture (42), a circular interior aperture (44) in the horizontal pipe, the rotatable sleeve being rotatable between an open first orientation with the interior and exterior apertures aligned and a closed second orientation with the interior and exterior apertures un-aligned for thereby varying the pressure of the water flowing there through as a function of the rotational orientation of the rotatable sleeve with respect to the horizontal pipe;

a T-coupler (48) having a horizontal first leg (50) and an axially aligned horizontal second leg (52) and a downward extending vertical third leg (54), male screw threads on the vertical third leg, a joining component (56) at the upper end of the vertical pipe with female screw threads for removably receiving the T-coupler;

a transparent plastic first sleeve (60) having an interior end attached to the first leg of the T-coupler, the first sleeve having a second end with a first cap, a transparent plastic second sleeve (58) having an interior end attached to the second leg of the T-coupler, the second sleeve having a second end with a second cap;

an illumination assembly including an inner cylinder (64) of a translucent cellulose material within the second sleeve, the inner cylinder having a closed end adjacent to the second cap, the inner cylinder having an open end within the T-coupler, the illumination assembly also including a power cylinder (66) with a first end adjacent to the first cap, the first end of the power cylinder having a button (76) extending through the first cap, the power cylinder having a second end within the T-coupler with a gasket (68) there around hydraulically sealing the first sleeve from the second sleeve and the T-coupler, a plurality of light emitting diodes (70) coupled to the second end of the power cylinder extending into the T-coupler, a plurality of batteries (72) within the power cylinder, electronic logic (74) within the first sleeve operative in response to depressing the button for activating and inactivating the light emitting diodes, the depressing of the button adapted to optionally operate the light emitting diodes in a continuous and discontinuous modes; and a spray assembly including apertures (78) in the second sleeve, the apertures facing upwardly and outwardly whereby water is adapted to move through the outlet, then through the pressure adjusting assembly, then through the T-coupler, then through the second sleeve exterior of the translucent sleeve, and then exiting through the apertures whereby the exiting water creates an illuminated fountain-like appearance while the light emitting diodes illuminate the exiting water and the first and second sleeves.

* * * * *